US005131556A

United States Patent [19]

Iioka et al.

[11] Patent Number: 5,131,556

[45] Date of Patent: Jul. 21, 1992

[54] EASY-OPEN LID

[75] Inventors: Toshiaki Iioka, Chigasaki; Yasuo Kaga, Yokohama; Hideo Kurashima, Yokosuka; Kazuo Taira, Tokyo; Yasushi Hatano, Yokohama, all of Japan

[73] Assignee: Toyo Seikan Kaisha, Ltd., Tokyo, Japan

[21] Appl. No.: 455,316

[22] PCT Filed: Dec. 9, 1988

[86] PCT No.: PCT/JP88/01244

§ 371 Date: Feb. 28, 1990

§ 102(e) Date: Feb. 28, 1990

[87] PCT Pub. No.: WO89/10310

PCT Pub. Date: Nov. 2, 1989

[30] Foreign Application Priority Data

Apr. 30, 1988 [JP] Japan ..... 63-105444

[51] Int. Cl.[5] ..... B65D 17/34

[52] U.S. Cl. ..... 220/270; 220/276; 220/359

[58] Field of Search ..... 220/270, 276, 359

[56] References Cited

U.S. PATENT DOCUMENTS 4,556,152 12/1985 Bogren ..... 220/276
4,572,393 2/1986 Kobayashi et al. ..... 220/270
4,784,284 11/1988 Miyauchi et al. ..... 220/270

*Primary Examiner*—Stephen Marcus
*Assistant Examiner*—Nova Sucker
*Attorney, Agent, or Firm*—Sughrue, Mion, Zinn, Macpeak & Seas

[57] ABSTRACT

The present invention relates to an easy-open vessel lid which is composed of a laminate of a metal foil and a resin and has opening weakened line. A reinforcing layer of a thermoplastic resin is formed independently from the resin of the laminate at least on the outer peripheral side of a part most protruding in the opening-initiating direction of an inside introducing weakened line to cover said weakened line astride of said weakened line. By this reinforcing layer, ribbon breaking can be effectively prevented, and opening by shearing of the lid member along the weakened lines can be performed assuredly and smoothly.

7 Claims, 6 Drawing Sheets

EASY-OPEN LID

DESCRIPTION

1. Technical Field

The present invention relates to an improvement in an easy-open lid comprising a laminate of a metal foil and a resin and an opening weakened line formed in the laminate, in which occurrence of ribbon breaking at the time of opening is prevented.

2. Technical Background

An easy-open lid comprising a laminate of a metal foil and a resin is widely used as a sealing lid for a light-weight vessel comprising a metal foil, a resin, a paper or a laminate thereof as the constituent material. In this easy-open lid, an opening weakened line defining a portion to be opened is formed in the laminate and an opening tab is fixed to the opening-initiating point of the portion to be opened, and opening is effected by breaking the lid along the weakened line.

In the field of the easy-open lid of this type, a so-called full-open lid in which an opening is formed on the substantially entire surface of the lid is desired. For this full-open lid, there is generally adopted a structure in which, as shown in FIG. 5-I of Japanese Patent Application Laid-Open Specification No. 152145/84, a portion to be opened is defined by an outer peripheral weakened line, an outside introducing weakened line and an inside introducing weakened line are formed, tearing is effected in a ribbon-like shape from an opening-initiating point, and then, the entire surface is opened.

In this full-open easy-open lid, ribbon breaking is often caused at the time of opening, rendering opening of the entire surface difficult. The term ribbon breaking means the phenomenon in which the ribbon-shaped portion defined by the outside introducing weakened line and the inside introducing weakened line undergoes a concentrated opening force at the initial stage of opening and is broken at the point close to the part most protruding in the opening-initiating direction of the inside introducing weakened line. This ribbon breaking is a phenomenon not observed in an easy-open can lid formed of an aluminum sheet, and this is a trouble occuring inherently in a lid formed of a laminate of a metal foil and a resin.

3. Gist of the Invention

It is therefore a primary object of the present invention to provide an easy-open lid of he above-mentioned metal foil/resin type, in which occurrence of ribbon breaking is prevented and opening of the entire surface of the lid can be performed assuredly and smoothly without failure.

More specifically, in accordance with the present invention, there is provided an easy-open vessel lid comprising a lid member composed of a laminate of a metal foil and a resin, a peripheral weakened line formed in the lid member, a portion to be opened, which is defined by the peripheral weakened line, an outside introducing weakened line, which is formed in the portion to be opened and reaches the peripheral weakened line, an inside introducing weakened line, which is formed in the portion to be opened and does not reach the outer peripheral weakened line, an opening-initiating part and a ribbon-shaped portion, which are defined by the outside introducing weakened line and the inside introducing weakened line, and an opening tab connected to the opening-initiating part, wherein a reinforcing layer of a thermoplastic resin is formed independently from said resin at least on the outer periphery side of a part most protruding in the opening-initiating direction of the inside introducing weakened line to cover said weakened line astride of said weakened line.

DESCRIPTION OF THE PREFERRED EMBODIMENTS

The easy-open lid of the present invention is characterized in that a reinforcing layer of a thermoplastic resin is formed independently from the resin of the laminate at a part most protruding in the opening-initiating direction of the inside introducing weakened line outwardly of the opening-initiating direction to cover said weakened line astride of said weakened line.

As pointed out hereinbefore, the reason why ribbon breaking is caused at the time of opening is that the opening force is concentrated on a part or in its vicinity most protruding in the opening-initiating direction of the inside introducing weakened line and a cut is formed in a ribbon-shaped portion defined by the inside introducing weakened line and the outside introducing weakened line by this concentrated stress. According to the present invention, by forming a reinforcing layer of a thermoplastic resin in the above-mentioned specific positional relation independently from the resin of the laminate, occurrence of this ribbon breaking can be effectively prevented.

In the present invention, by forming a reinforcing layer of a thermoplastic resin at least on the outer periphery side of a part most protruding in the opening-initiating direction of the inside introducing weakened line (sometimes referred to as "most protruding part") to cover said weakened line astride of said weakened line, occurrence of ribbon breaking is effectively prevented and opening is effected by shearing of the lid along the weakened line. This was found as a phenomenon and has not been theoretically supported sufficiently. It is expected that if a reinforcing layer of a resin is formed astride of the weakened line, shearing of not only the circumference of the weakened line but also the weakened line per se will probably become difficult. Contrary to this expectation, shearing along the weakened line becomes possible. The reason is considered to be as follows.

Figure 1:
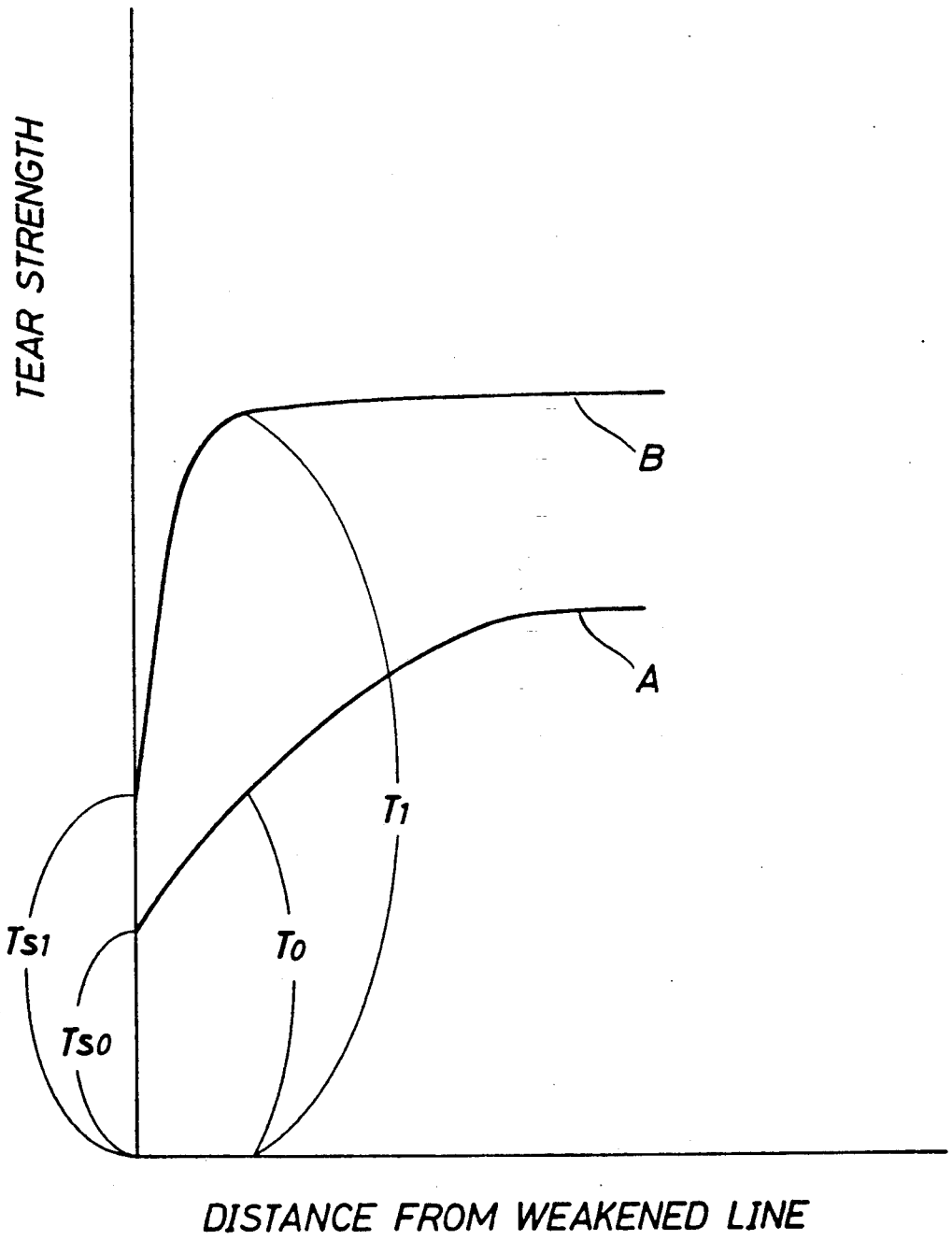
FIG. 1 shows curves of the distribution of the tear strength of (A) a laminate having a weakened line and (B) a product obtained by forming a reinforcing resin layer astride of this weakened line of this laminate.

FIG. 1 of the accompanying drawings is a conceptional view showing the distribution of the tear strength in the portion of the weakened line and the surrounding portion, and curve A shows the tear strength distribution in the laminate alone and curve B shows the tear strength distribution in the laminate in which the reinforcing resin layer is formed astride of the weakened line. From FIG. 1, it is seen that the following relation is established between the tear strengths Tso and Tsi in the portions of weakened lines and the tear strengths To and Ti at positions slightly apart from the weakened lines:

$$Tsi - Tso < Ti - To$$

This relation will now be described. Even if the reinforcing resin layer is formed, since the weakened line acts as a clue to shearing, the tear strength Tsi in the direction of the weakened line is not much larger than the value Tso in the laminate having no reinforcing layer, but the tear strength Ti in the portion other than the weakened line is larger by the value corresponding to the increase of the thickness than the tear strength To of the laminate having no reinforcing layer. If a weakened line (score) is formed in the laminate, the thickness of the portion in the vicinity of the weakened line is reduced at the processing step, and the distribution of the tear strength becomes gentle as shown by curve A. In contrast, if the reinforcing layer is formed, the distribution of the tear strength abruptly rises at a part apart from the portion of the weakened line. It is considered that because of the combination of these factors, shearing can be performed assuredly and easily, and ribbon breaking can be effectively prevented.

Several additional advantages can be attained in the present invention by forming a reinforcing layer of a thermoplastic resin astride of the weakened line. In the first place, strict positioning is not necessary at the time of applying the reinforcing layer, and the reinforcing layer can be formed assuredly on the outer periphery side of the most protruding portion of the inside introducing weakened line where ribbon breaking is readily caused. In the second place, even if a defect such as a pinhole or crack is generated in the laminate at the time of forming the weakened line, since the defect is covered with the reinforcing layer of the thermoplastic resin, complete protection can be attained.

Structure of Lid

Figure 2:
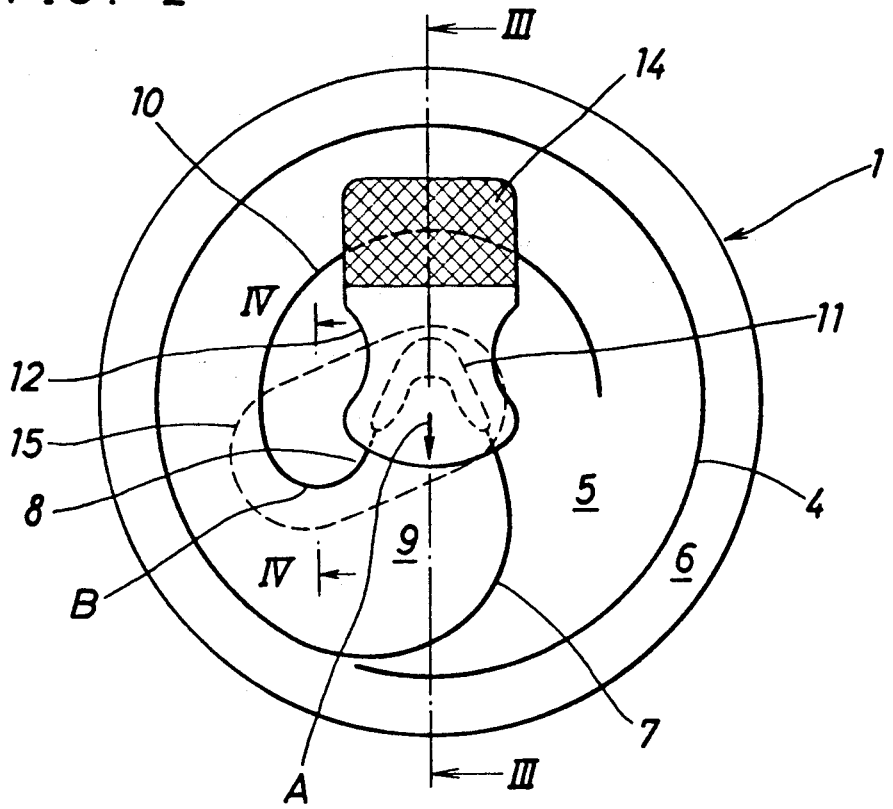
FIG. 2 is a top view showing an embodiment of the easy-open lid of the present invention.
Figure 3:
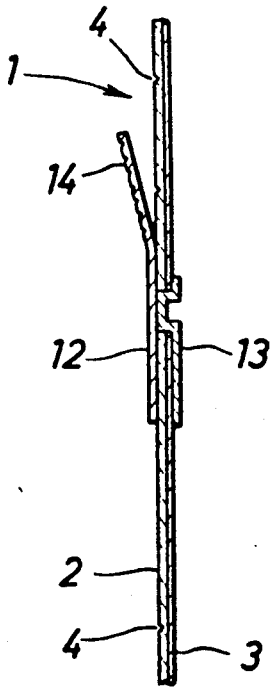
FIG. 3 is a view showing the section taken along the line III—III of the lid shown in FIG. 2.
Figure 4:
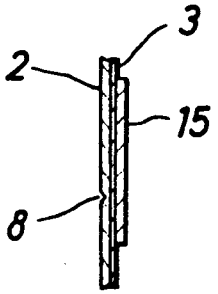
FIG. 4 is a view showing the section taken along the line IV—IV of the lid shown in FIG. 2.

Referring to FIGS. 2, 3 and 4 illustrating one embodiment of the easy-open lid of the present invention, this lid member 1 is formed of a laminate comprising a metal foil 2 and a resin film 3. A peripheral weakened line 4 is formed on the lid member 1, and a portion 5 to be opened is formed inwardly of the peripheral weakened line 4 and a heat-sealing peripheral edge portion 6 is formed outwardly of the portion 5 to be opened. In the portion 5 to be opened, there are formed an outside introducing weakened line 7 on the side of the outer periphery, which extends substantially from the center of the lid and reaches the peripheral weakened line 4, and an inside introducing weakened line 8 on the side of the center, which does not reach the peripheral weakened line 4. A ribbon-shaped part is defined by both the introducing weakened lines 7 and 8. In this embodiment, the inside introducing weakened line 8 has a circular extension (weakened line) 10 concentric with the peripheral weakened line 4, which has a diameter smaller than that of the peripheral weakened line 4.

An opening-initiating part 11 is formed at the beginning ends of both the introducing weakened lines 7 and 8. In the present embodiment, the opening-initiating part 11 is a V-shaped small hole, and an opening tab 12 is formed to cover the V-shaped small hole from the outer side, and an inner patch 13 is formed to cover the V-shaped small hole from the inner surface side. The small hole 11 is sealed by fusion-bonding the opening tab 12 and inner patch 13 to each other. A grip 14 is formed at the end of the opening tab 12. The center line of the opening tab 12 is ordinarily made substantially in agreement with the center line of the ribbon-shaped part 9, and this direction, that is, the direction of arrow A in FIG. 2, is the opening-initiating direction.

Referring to FIG. 2, the portion most protruding in the opening-initiating direction of the inside introducing weakened line 8 is located at a position indicated by B, and at the time of opening, a cut is formed in the ribbon-shaped portion 9 from this position B to cause ribbon breaking. In the present invention, a reinforcing layer 15 of a thermoplastic resin is formed to cover the periphery of the weakened line 8 astride of the weakened line 8 at the position B and in the vicinity thereof. In the embodiment illustrated in FIGS. 2 through 4, the inner patch 13 and reinforcing resin layer 15 are integrally formed of one film, and as clearly shown in FIG. 2, one ellipsoidal film covering both the portions is applied to the inner surface of the lid. Of course, it will be understood that the inner patch 13 and reinforcing resin layer 15 can also be formed of two individual films.

When the lid of the present invention is opened, by gripping the grip 14 of the opening tab 12 and pulling it upward, the inner patch 13 is raised in the portion of the hole 11 in the state adhering to the opening tab 12 to initiate the opening. Then, both the introducing weakened lines 7 and 8 are shown and the ribbon-shaped part 9 is raised. In this case, for the above-mentioned reason, ribbon breaking is prevented also at the most protruding part B of the inside introducing weakened line 8. The opening force of pulling the opening tab 12 is converted to a turning force, and shearing of the peripheral weakened line 4 and extended weakened line 10 is advanced and full opening becomes possible.

Figure 5:
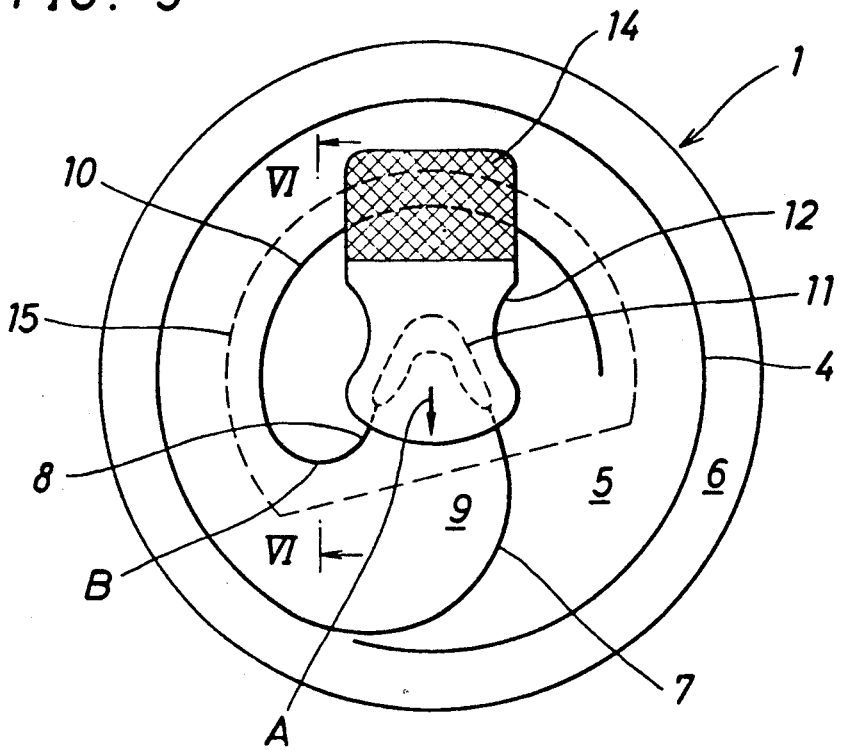
FIG. 5 is a top view showing a lid in which a reinforcing resin layer is formed to cover an inside weakened line and an entire extension thereof.
Figure 6:
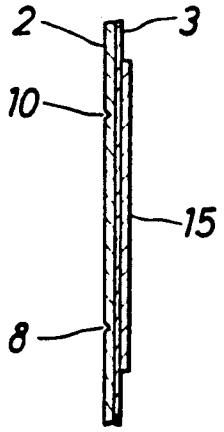
FIG. 6 is a view showing the section taken along the line VI—VI of the lid shown in FIG. 5.
Figure 7:
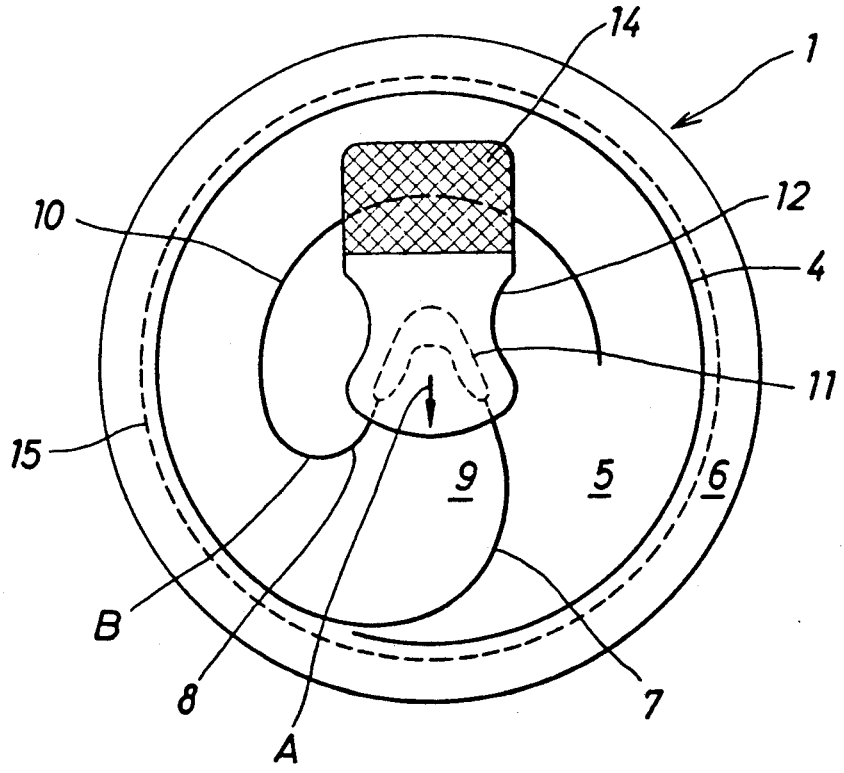
FIG. 7 is a top view showing a lid in which a reinforcing resing layer is formed to cover all of weakened lines.

In the present invention, the reinforcing resin layer 15 can be formed at an optional position with an optional shape without departing from the spirit of the present invention. For example, as shown in FIGS. 5 and 6, the reinforcing resin layer 15 is formed to entirely cover the inside introducing weakened line 8 and the extended weakened line 10 thereof, or as shown in FIG. 7, the reinforcing resin layer 15 is formed to cover all of the weakened lines 4, 7, 8 and 10.

Figure 8:
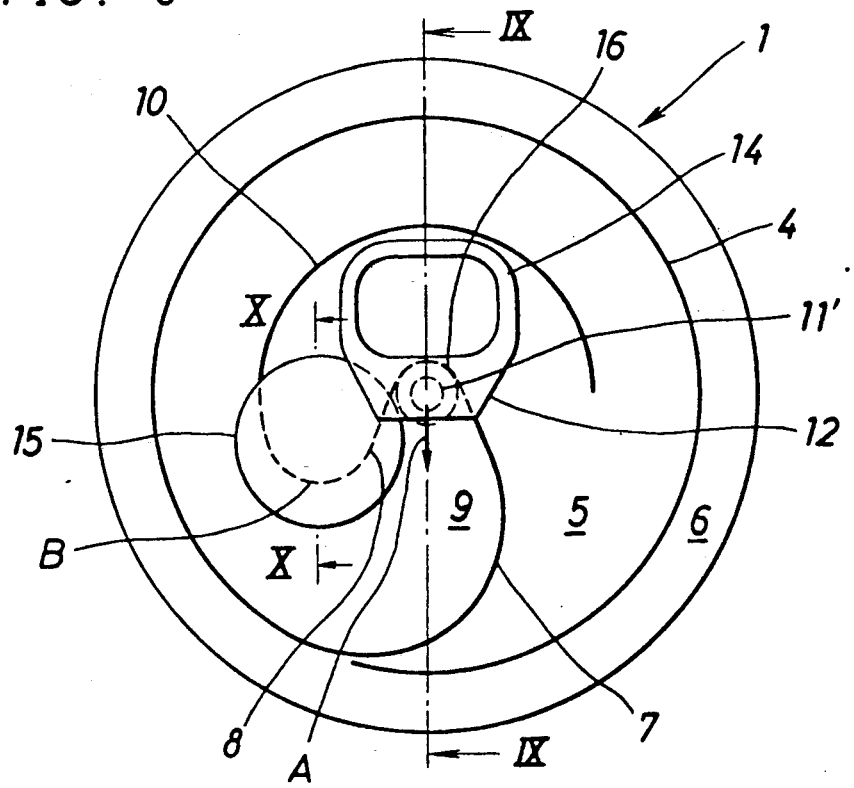
FIG. 8 is a top view showing another embodiment of the easy-open lid of the present invention.
Figure 9:
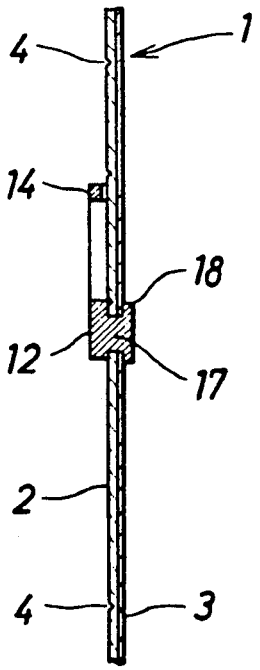
FIG. 9 is a view showing the section taken along the line IX—IX of the lid shown in FIG. 8.
Figure 10:
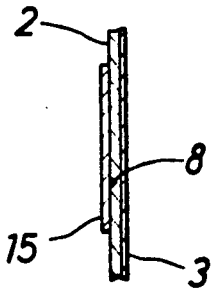
FIG. 10 is a view showing the section taken along the line X—X of the lid shown in FIG. 8.

In the easy-open lid of the present invention, the opening tab can be fixed to the lid member by riveting. Referring to FIGS. 8, 9 and 10 illustrating this embodiment, beginning ends of the outside introducing weakened line 7 and the inside introducing weakened line 8 are connected to each other to form a portion 16 having a large curvature. A small hole 11' is formed on the side of the center of the large curvature portion. A rivet 17 of the opening tab 12 is inserted in this small hole 11' and the end portion of the rivet 17 is expanded, and the rivet 17 is fusion-bonded to the resin layer 3 of the lid 1 to effect fixation and sealing of the opening tab 12. The reinforcing resin layer 15 is formed on the outer surface of the lid 1 to cover the most protruding part of the inside introducing weakened line and the surrounding portion thereof.

Constituents of Lid and Process for Preparation of Lid

A light metal foil such as an aluminum foil is preferably used as the metal foil of the laminate. Of course, an iron foil, a steel foil and a tinplate foil can be used. In view of the resistance to the heating sterilization, it is preferred that the metal foil be one that has been subjected to a preliminary treatment such as an alumite treatment, a boehmite treatment, a chemical treatment with phosphoric acid and/or chromic acid or a conversion treatment.

The metal foil should have a certain rigidity enough to make tearing possible, and from this viewpoint, it is preferred that the thickness of the metal foil be at least 30 μm, especially at least 50 μm. From the economical viewpoint and in order to prevent the finger or the like from being hurt at the time of opening, it is preferred that the upper limit of the thickness of the metal foil be 200 μm, especially 150 μm.

As the resin of the laminate, resins having a heat sealability, for example, olefin resins such as low-density polyethylene, medium-density polyethylene, high-density polyethylene, isotactic polypropylene, a propylene/ethylene copolymer, a propylene/butene-1 copolymer, an ethylene/vinyl acetate copolymer (EVA), an ethylene/ethyl acrylate copolymer and an ionomer, are used. It is preferred that the thickness of the resin layer be 5 to 100 μm, especially 10 to 70 μm. Lamination of the resin layer and metal foil can be performed by using, for example, a urethane type adhesive, an epoxy type adhesive and an acid-modified olefin type adhesive.

The laminate has a multi-layer structure including other layers in addition to the above-mentioned two layers. For example, a paper layer or protecting resin layer can be formed on the surface of the metal foil. As the protecting resin layer, there can be used a high-tenacity plastic film such as a biaxially drawn polyester film, a biaxially drawn polypropylene film or a biaxially drawn nylon film, and a coating of an epoxy-phenolic paint, an epoxy-urea paint, an epoxy-melamine paint, a vinyl paint, an acrylic paint or an epoxy-acrylic paint.

The laminate is formed into a lid through press forming (draw forming), punching, formation of a surrounding curled portion and draw forming of a panel portion. Then, scores are formed in the metal foil and holes are pierced.

Alternately, there can be adopted a method in which holes and scores are formed in the laminate, the opening tab and reinforcing layer are bonded, and the laminate is punched to form a lid.

In view of the gas barrier property, the pressure resistance and the resistance to the falling shock, it is important that scores should remain in the midway of the thickness of the metal foil. In view of the above-mentioned characteristics and the easy openability, it is preferred that the depth of the scores be 3/10 to 7/10, especially 2/5 to 3/5, of the thickness of the metal foil and the residual thickness of the metal foil in the scored portion be at least 10 μm, especially at least 20 μm.

As the opening tab, there can be used a tab formed from a laminate having a layer structure similar to the layer structure mentioned above with respect to the lid member, and an opening tab provided with a rivet formed of an olefin resin similar to the inner face material of the lid member.

Various resin films can be used as the reinforcing layer of the thermoplastic resin, but use of a film of an olefin resin similar to the inner face material of the lid member is especially advantageous. It is preferred that the thickness of the reinforcing layer be 20 to 150 μm, especially 40 to 100 μm, and the tensile modulus be 20 to 150 kg/mm$^2$.

Fixation of the opening tab or bonding of the reinforcing layer to the lid can be advantageously performed by the heat bonding method such as heat fusion bonding, but needless to say, bonding and fixation can be accomplished by using an adhesive or the like.

The lid of the present invention is advantageously used as a heat-sealing lid for heat-sealing an optional vessel, for example, a paper/plastic/aluminum foil composite vessel, a metal can, a wide-mouth bottle, a plastic cup, a metal foil vessel or a metal foil/plastic composite vessel. Particularly, the lid of the present invention is advantageously used for sealing an easy-buckling vessel to which double seaming cannot be applied, and a packaged vessel requiring hot filling, heat sterilization, and the lid of the present invention is especially preferably used as a heat-sealing lid for a plastic cup prepared by vacuum forming, a monoaxially or biaxially drawn plastic cup obtained by plug assist forming or compressed air forming, or a metal foil vessel obtained by draw forming. As typical instances of the vessel to which the lid of the present invention is applied, there can be mentioned a vessel having an aluminum or steel foil and a heat-sealable resin film layer formed on the inner and outer surfaces of the foil, and a composite can or cup-shaped vessel provided with a paper and a metal foil.

According to the present invention, by forming a reinforcing layer of a thermoplastic resin at least on the outer peripheral side of the portion most protruding in the opening-initiating direction of the inside introducing weakened line to cover said weakened line astride of said weakened line, ribbon breaking can be effectively prevented, and opening by shearing of the lid along the weakened line can be performed assuredly and smoothly. Furthermore, by forming the reinforcing layer of the thermoplastic resin astride of the weakened line, strict positioning is not necessary when the reinforcing layer is applied, and the reinforcing layer can be formed assuredly on the outer peripheral side of the most protruding portion of the inside introducing weakened line where ribbon breaking is readily caused. Moreover, even if a defect such as a pinhole or crack is generated on the laminate when a weakened line is formed, this defect is covered with the reinforcing layer of the thermoplastic resin and complete protection can be obtained. These are advantages attained by the present invention.

EXAMPLES

EXAMPLE 1

A soft aluminum foil having a thickness of 50 μm, on the outer surface of which an epoxy-phenolic paint had been coated and baked, was prepared, and a polypropylene film having a thickness of 65 μm was extrusion-laminated on the inner surface of the aluminum foil to obtain a lid material.

The lid material was punched into a disk having a diameter of 80 mm by press forming, and a V-shaped small hole was formed through the disk in the central portion thereof by press forming. A weakened line was formed on the coated and baked side of the lid member by press forming so that the weakened line was connected to the top end of the V-shaped small hole and the residual thickness in the portion of the weakened line was about 25 μm, whereby a lid member having a shape as shown in FIGS. 2, 3 and 4 was prepared.

A biaxially drawn polyester film having a thickness of 12 μm was bonded to one surface of a soft aluminum foil having a thickness of 9 μm by using an adhesive, and a polypropylene film having a thickness of 50 μm was extrusion-laminated on the other surface of the aluminum foil. An opening tab having a width of 20 mm and a length of 35 mm was cut out from the obtained laminate. A reinforcer having a width of 20 mm and a length of 33 mm was formed from a polypropylene film having a thickness of 50 μm. The opening tab was placed on the outer surface of the lid member in such a manner that the V-shaped small hole of the lid member was covered with the opening tab, and simultaneously, the reinforcer was placed on the inner surface of the lid member to cover said small hole and the surrounding portion of the part most protruding in the opening-initiating direction of the inside introducing weakened line. The reinforcer and a heat-resistant rubber sheet having a thickness of 1 mm were placed face to face and press-bonded and the opening tab and lid member were placed face to face and pressed by a hot plate heated at 200° C. in such a manner that a peelable seal was produced between the outer surface of the lid member and a tight seal was produced in the inner surface of the lid member and the opening tab to the reinforcer, whereby heat sealing was completed. By this heat sealing, the opening tab was connected to the opening-initiating part and an easy-open vessel lid of the present invention, as shown in FIGS. 2 through 4, was prepared.

Corn soup was hot-filled in a cylindrical cupshaped vessel having an inner volume of about 80 cc, which was prepared by deep draw forming of a laminate obtained by extrusion-laminating polypropylene on the inner and outer surfaces of a steel foil having a thickness of 75 μm, and the above-mentioned easy-open vessel lid of the present invention was heat-sealed to the vessel. The lidded vessel was subjected to the retort sterilization at 115° C. for 50 minutes. Then, the opening tab was held by the hand and the opening was effected in the opening-initiating direction. The result of the evaluation of the openability (frequency of occurrence of ribbon breaking) is shown in Table 1.

EXAMPLE 2

An easy-open vessel lid as shown in FIGS. 5 and 6 was prepared by using the same materials according to the same procedures as described in Example 1. The reinforcer of polypropylene was arranged on the inner surface of the lid member to entirely cover the small hole of the lid member, the inside introducing weakened line and the extension thereof. The openability was evaluated according to the same procedures as described in Example 1. The obtained result is shown in Table 1.

EXAMPLE 3

A disk having a diameter of 80 mm was punched out from the same lid material as described in Example 1 by press forming, and a circular small hole having a diameter of 4 mm was formed at the center of the disk by press forming. Weakened lines were formed on the outer surface side of the disk in the same manner as described in Example 1 except that the weakened line in the vicinity of the circular small hole was formed, whereby a lid member as shown in FIG. 8 was prepared. A reinforcer having a diameter of 20 mm was prepared from a polypropylene film having a thickness of 50 μm. The reinforcer was placed on the outer surface of the lid member to cover the surrounding portion of the part most protruding in the opening-initiating direction of the inside introducing weakened line. The inner surface of the lid member and a heat-resistant rubber sheet having a thickness of 1 mm were placed face to face and press-bonded and the reinforcer was pressed by a hot plate heated at 200° C., whereby heat sealing was completed. An opening tab of polypropylene having a cylindrical rivet having a diameter of 3.9 mm and a length of 4 mm, which could be fitted in the above-mentioned small hole, and a ring in which a forefinger could be inserted, was prepared by injection molding. The rivet of the opening tab was fitted from the outer surface side of the lid member, and the head portion protruding to the inner surface side of the lid member was crushed by a hot plate heated at 200° C. and fusion-bonded to the polypropylene of the inner surface, whereby an easy-open vessel lid of the present invention, as shown in FIG. 8, was prepared.

The openability was evaluated according to the same procedures as described in Example 1. The obtained result is shown in Table 1.

COMPARATIVE EXAMPLE 1

Figure 11:
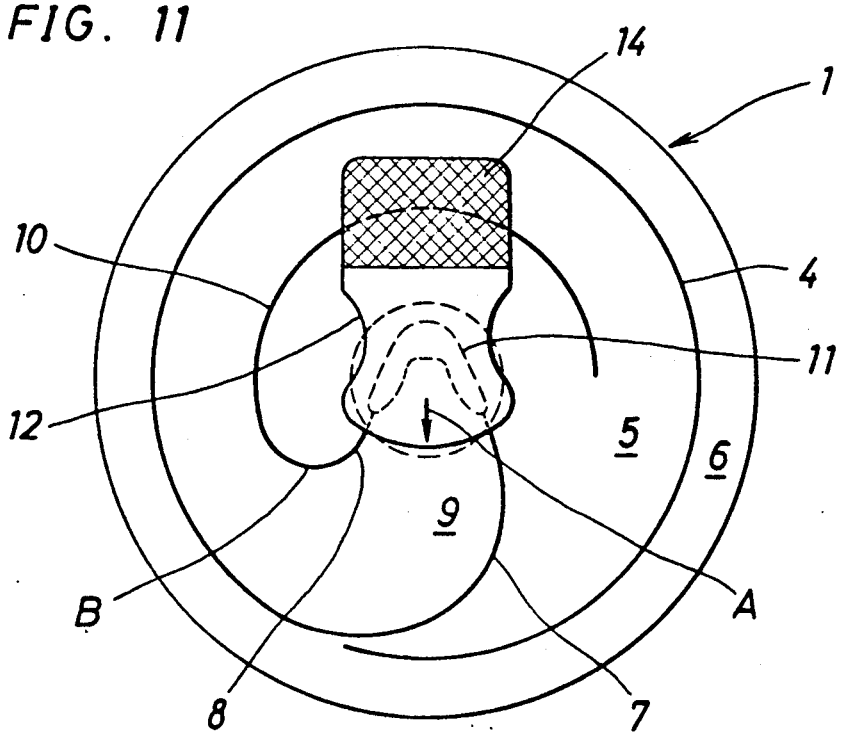
FIG. 11 is a top view showing a lid similar to the lid shown in FIG. 2 except that the reinforcing resin layer is not formed.

An easy-open vessel lid as shown in FIG. 11 was prepared by using the same materials according to the same procedures as described in Example 1. The inner patch was arranged to cover the small hole but did not cover the part most protruding in the opening-initiating direction of the inside introducing weakened line.

The openability was evaluated according to the same procedures as described in Example 1. The obtained result is shown in Table 1.

Comparative Example 2

Figure 12:
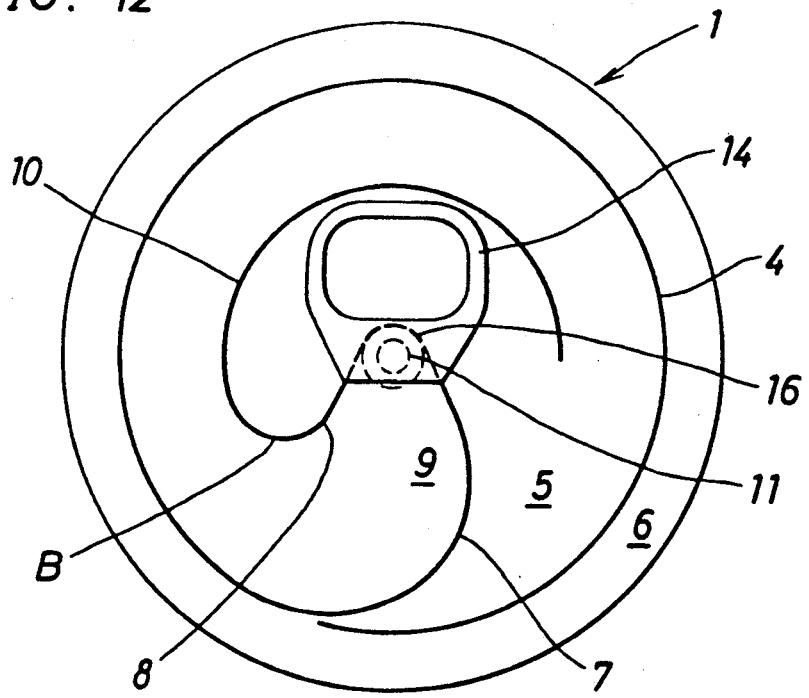
FIG. 12 is a top view showing a lid similar to the lid shown in FIG. 8 except that the reinforcing resin layer is not formed.

A disk having a diameter of 80 mm was punched out from the same lid material as used in Example 1 by press forming, and a circular small hole having a diameter of 4 mm was formed at the center of the disk by press forming. Weakened lines were formed on the outer surface side of the disk in the same manner as described in Example 1 except that the weakened line in the vicinity of the circular small hole was formed, whereby a lid member as shown in FIG. 12 was prepared. An opening tab having a cylindrical rivet having a diameter of 3.9 mm and a length of 4 mm, which could be fitted in the circular small hole, and a ring in which a forefinger could be inserted, was prepared by injection molding, and the rivet of the opening tab was fitted from the outer surface side of the lid member and the head of the rivet protruding to the inner surface side of the lid member was crushed by a hot plate heated at 200° C. and fusion-bonded to the polypropylene of the inner surface, whereby an easy-open vessel lid as shown in FIG. 12 was prepared. Incidentally, the reinforcer was not bonded to this vessel lid. The openability was evaluated in the same manner as described in Example 1. The obtained result is shown in Table 1.

From the results shown in Table 1, it is seen that occurrence of ribbon breaking is much controlled in the lids of the present invention as compared with the comparative lids.

TABLE 1

| | Example 1 | Example 2 | Example 3 | Comparative Example 1 | Comparative Example 2 |
|---|---|---|---|---|---|
| Frequency of Occurrence of Ribbon Breaking (lids/lids) | 0/15 | 0/15 | 0/15 | 14/15 | 13/15 |

What is claimed is:

1. An easy-open vessel lid formed of a laminate comprising a metal foil and a resin layer, said lid comprising
- a peripheral weakened line formed in the lid;
- a portion to be opened formed inwardly of the peripheral weakened line;
- a heat-sealing peripheral edge portion formed outwardly of the peripheral weakened line;
- an opening-initiating weakened line having a large curvature protruding in an opposite direction to an opening initiating direction formed in the portion to be opened;
- an outside introducing weakened, arched line, one end of which is connected to one end of the opening-initiating weakened line, the other end of which reaches the peripheral weakened line, and which extends in the opening-direction;
- an inside introducing weakened circumferential line, one end of which is connected to the other end of the opening-initiating weakened line and which has an introducing part extending in the opening-initiating direction, a most protruding part in the opening-initiating direction and a circular extension substantially concentric with the peripheral weakened line, said extension having a diameter smaller than that of the peripheral weakened line;
- an opening-initiating part defined by the opening-initiating weakened line;
- a spiral ribbon-shaped portion connected to said opening-initiating part which is defined by said outside introducing weakened, arched line and said inside introducing weakened circumferential line;
- an opening tab fitted to the outer surface of the opening-initiating part; and
- a reinforcing layer of a thermoplastic resin adhered to said laminate so as to cover the most protruding part of the inside introducing weakened circumferential line astride said inside introducing weakened circumferential line.

2. An easy-open vessel lid as set forth in claim 1, wherein the reinforcing layer of the thermoplastic resin is arranged at a position entirely covering the inside introducing weakened line and the extension thereof.

3. An easy-open vessel lid as set forth in claim 1, wherein the reinforcing layer of the thermoplastic resin is arranged to cover all of the weakened lines.

4. An easy-open vessel lid as set forth in claim 1, wherein the reinforcing layer is an olefin resin film.

5. An easy-open vessel lid as set forth in claim 1, wherein the thickness of the reinforcing layer is 20 to 150 μm.

6. An easy-open vessel lid as set forth in claim 1, wherein the tensile modulus of the reinforcing layer is 20 to 150 kg/mm$^2$.

7. An easy-open vessel lid formed of a laminate comprising a metal foil and a resin layer, said lid comprising
- a peripheral weakened line formed in the lid;
- a portion to be opened formed inwardly of the peripheral weakened line;
- a heat-sealing peripheral edge portion formed outwardly of the peripheral weakened line;
- an opening-initiating V-shaped hole having a large curvature protruding in an opposite direction to an opening-initiating direction formed in the portion to be opened;
- an outside introducing weakened, arched line, one end of which is connected to one end of the V-shaped hole, the other end of which reaches the peripheral weakened line, and which extends in the opening-direction;
- an inside introducing weakened circumferential line, one end of which is connected to the other end of the V-shaped hole and which has an introducing part extending in the opening-initiating direction, a most protruding part in the opening-initiating direction and a circular extension substantially concentric with the peripheral weakened line, said extension having a diameter smaller than that of the peripheral weakened line;
- a spiral ribbon-shaped portion defined by said outside introducing weakened, arched line, said inside introducing weakened circumferential line and said V-shaped hole;
- an opening tab fitted to the outer-surface of the lid so as to cover the V-shaped hole;
- a reinforcing layer of a thermoplastic resin bonded to the inner surface of said lid so as to cover the most protruding part of the inside introducing weakened circumferential line astride said inside introducing weakened circumferential line, and to cover the V-shaped hole; and
- an opening-initiating part formed by bonding said opening tab with said reinforcing layer through said V-shaped hole and sealing said V-shaped hole.

* * * * *